United States Patent [19]

O'Brien et al.

[11] Patent Number: 4,915,305

[45] Date of Patent: Apr. 10, 1990

[54] SPRAY NOZZLE BOOM MOUNTING ARRANGEMENT

[75] Inventors: Edward J. O'Brien, Barrington; Ted Butterfield, Naperville; Lyle Emory, Darien, all of Ill.

[73] Assignee: Spraying Systems Co., Wheaton, Ill.

[21] Appl. No.: 840,981

[22] Filed: Mar. 14, 1986

Related U.S. Application Data

[63] Continuation of Ser. No. 428,786, Sep. 30, 1982, abandoned.

[51] Int. Cl.[4] ..... B05B 1/14

[52] U.S. Cl. ..... 239/550; 239/600

[58] Field of Search ..... 239/159, 390, 399, 450, 239/550, 596, 600; 248/74.1, 74.4, 75, 76, 78

[56] References Cited

U.S. PATENT DOCUMENTS

| | | | |
|---|---|---|---|
| 1,303,347 | 5/1913 | McFeaters | 248/74.4 X |
| 1,621,645 | 3/1927 | Thorp | 248/316.7 |
| 1,960,472 | 5/1930 | Balaam | 239/550 |
| 1,963,908 | 6/1934 | Manasek | 248/74.1 |
| 2,544,176 | 3/1951 | Palmer | 239/550 |
| 2,644,720 | 7/1953 | Carr | 239/550 |
| 3,107,076 | 10/1963 | Rosselet | 248/74.7 |
| 3,158,324 | 11/1964 | Oehler et al. | 239/15 A |
| 3,310,264 | 3/1967 | Appleton | 248/74.1 X |
| 3,385,545 | 5/1968 | Patton | 248/74.1 |
| 3,591,091 | 7/1971 | Galloway et al. | 239/596 |
| 4,046,344 | 9/1977 | Scanlan | 248/74.4 X |
| 4,059,872 | 11/1977 | Delesandri | 248/75.1 X |
| 4,456,180 | 6/1984 | Lury | 239/600 X |

FOREIGN PATENT DOCUMENTS

| | | | |
|---|---|---|---|
| 509529 | 4/1929 | Fed. Rep. of Germany . | |
| 1099326 | 3/1955 | France | 248/68.12 |

*Primary Examiner*—Andres Kashnikow
*Assistant Examiner*—Kevin P. Weldon
*Attorney, Agent, or Firm*—Leydig, Voit & Mayer

[57] ABSTRACT

A clamping arrangement for quickly and easily mounting a spray nozzle on a support boom in predetermined orientation without the necessity for handling of separate fasteners and without disassembly of the nozzle. The clamping arrangement includes a pair of clamping elements that each have first cooperating portions for positioning about opposed sides of the support boom and second cooperating portions for positioning about opposed sides of the nozzle, and at least one of the clamping elements carries a fastener that is engageable with the other clamping element for securing the elements in mounted position on the boom with the nozzle captively held therein. The nozzle and clamping elements cooperate to both angularly and vertically orient the nozzle in relatively precise predetermined relation to the boom as an incident to such mounting.

14 Claims, 2 Drawing Sheets

SPRAY NOZZLE BOOM MOUNTING ARRANGEMENT

This application is a continuation, of application Ser. No. 428,786, now abandoned, filed Sept. 30, 1982.

DESCRIPTION OF THE INVENTION

The present invention relates generally to spray nozzles, and more particularly, to the mounting of spray nozzles on a support boom.

In many industrial, agricultural, and commercial fluid spraying applications, it is necessary for a plurality of spray nozzles to be mounted in a longitudinal array. The spacing between the nozzles for each application generally is selectively determined by the spray pattern characteristics of the nozzle and the degree of spray overlap desired. While various clamping arrangements have been utilized for mounting spray nozzles at determined locations along support booms, such prior clamping arrangements commonly have been cumbersome to assemble, have required handling of separate clamp fasteners and the like, and often necessitate at least partial disassembly of the nozzle during the mounting procedure. Mounting problems have been compounded when the nozzles also must be angularly oriented during mounting in order to effect proper distribution of a particular spray pattern. Because relatively large numbers of nozzles can be used in a single installation, the mounting and orientation of the nozzles with such clamps can require considerable time. Moreover, because the nozzles often are exposed to severe vibrations during use, such as when an agricultural sprayer is pulled along a field, the nozzles sometime can become disoriented, which effects proper distribution of the spray and necessitates periodic readjustment of the nozzles.

It is a primary object of the present invention to provide an improved means and method for quickly and accurately mounting spray nozzles on a support boom.

Another object is to provide a spray nozzles mounting arrangement as characterized above which permits mounting of nozzles on a support boom without the need for handling of separate fasteners and without disassembly of the nozzles.

A further object is to provide a spray nozzle mounting arrangement of the above kind that is adapted to automatically establish relatively precise nozzle tip orientation during mounting and to retain such orientation during use. A related object is to provide such a nozzle mounting arrangement that establishes both vertical and angular orientation of the nozzle as an incident to mounting the nozzle on the support boom.

Other objects and advantages of the invention will become apparent from the following detailed description and the accompanying drawings, in which.

Figure 2:
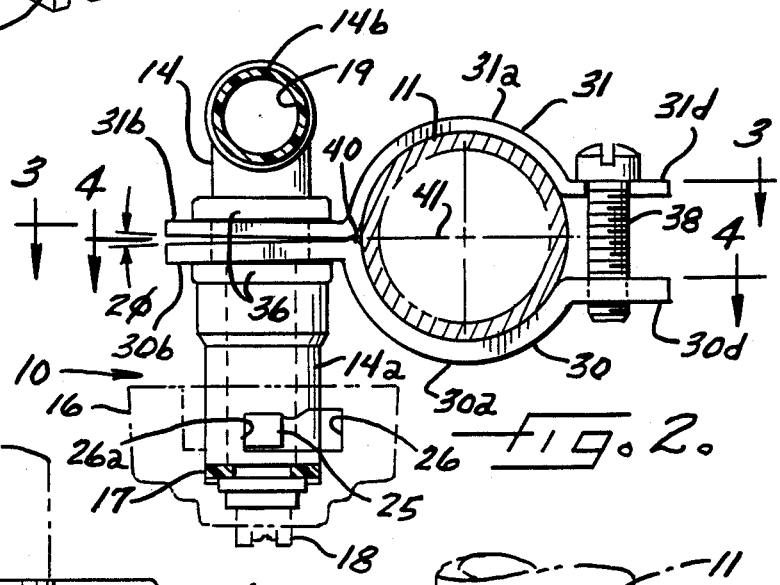
FIG. 2 is a vertical section taken in the plane of line 2—2 of FIG. 1.
Figure 3:
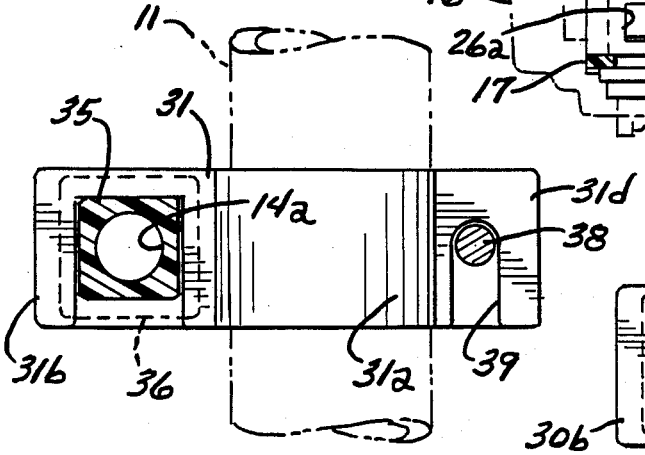
Figure 4:
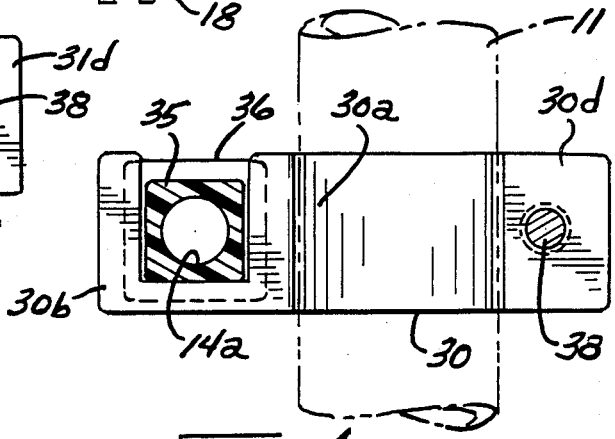
Figure 5:
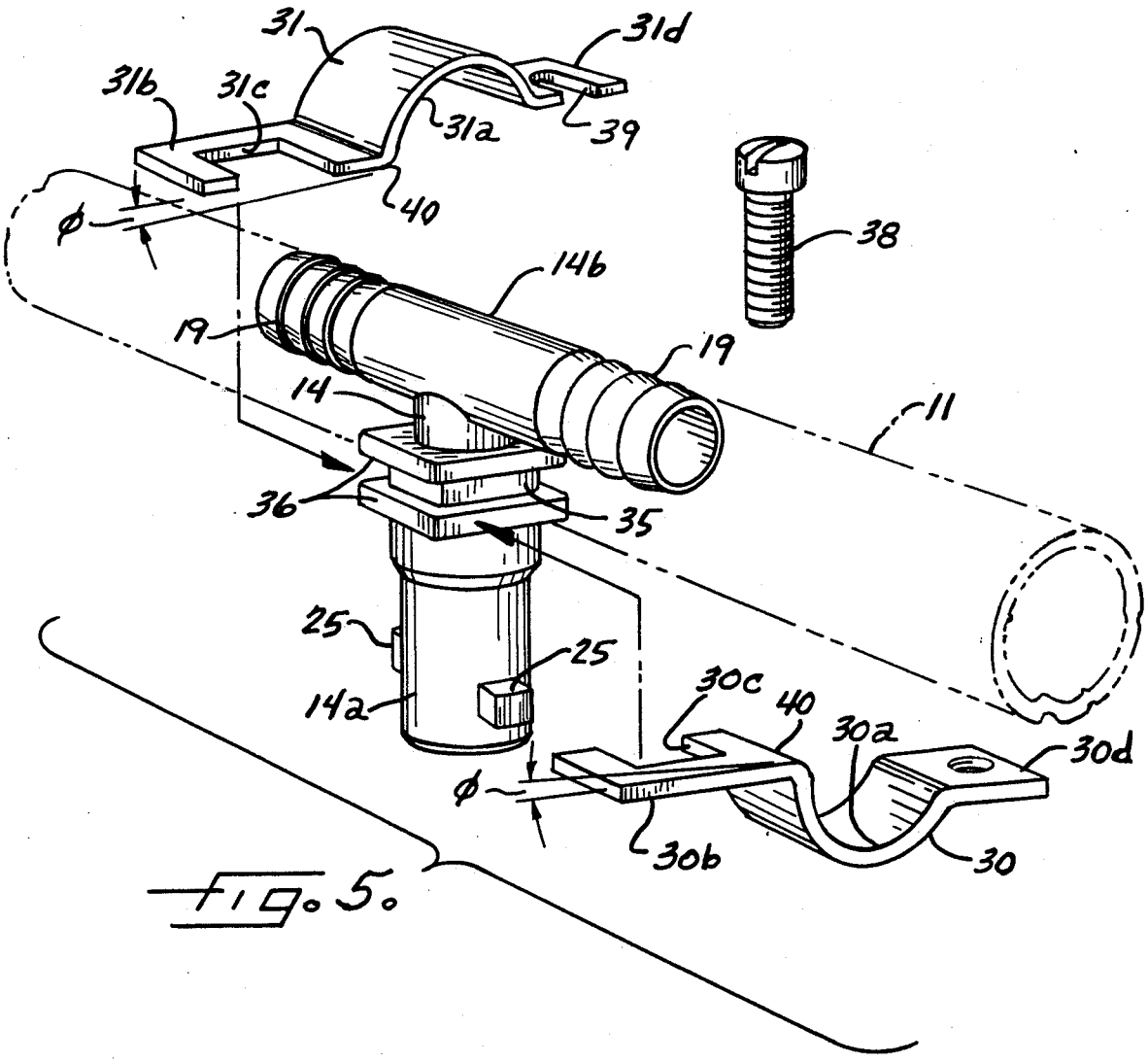

FIGS. 3 and 4 are sections taken in the planes of lines 3—3 and 4—4, respectively, in FIG. 2; and FIG. 5 is an exploded view of components of the illustrated nozzle boom mounting arrangement shown in dissembled form.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to the drawings, there is shown an illustrative spray nozzle assembly 10 mounted on a support boom 11 by a nozzle mounting arrangement embodying the present invention. The support boom 11 in this instance is a cylindrical tubular member, although other forms and shapes of support booms could be used. It will be appreciated that while a single nozzle assembly 10 is illustrated, a plurality of similar nozzle assemblies customarily would be mounted at predetermined spaced intervals along the length of the support boom. It will also be understood by one skilled in the art that such boom mounting of spray nozzles can be utilized in various installations, such as mobile agricultural sprayers, stationary industrial spraying systems, and many others.

The illustrated spray nozzle assembly 10 includes a main body member 14 and a removably mounted cap 16 at a lower end thereof which carries a spray tip 18. The body member 14 in this instance has a T-shaped configuration with a depending, tubular-discharge portion **14*a* and an upper, horizontal, tubular-inlet portion 14*b* having integrally formed, opposed hose connectors 19 at its opposite ends for coupling respective hose sections 20 of a fluid supply line. The hose connectors 19 each preferably are barbed for resisting withdrawal movement of a hose section 20 positioned thereon, and to further secure the hose section 20 in place on the connector 19 a ring clamp 21 is mounted over the end of each connector 19 and hose section 20 and tightened by a clamping screw 22. It will be appreciated that pressurized fluid introduced into the supply line may supply fluid to a plurality of such interconnected nozzle assemblies 10, with the fluid passing through the horizontal tubular portion 14*b* of each nozzle assembly and downwardly through the vertically depending portion 14*a* for discharge through the nozzle spray tip 18**.

Figure 1:
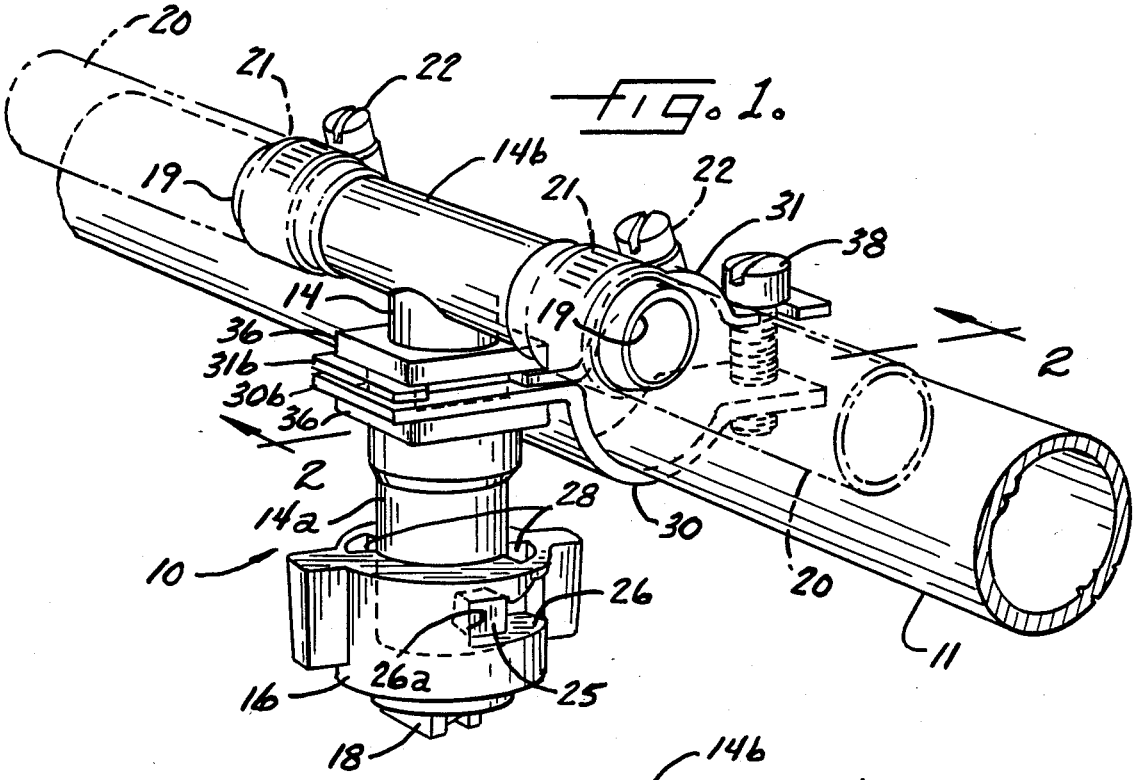
FIG. 1 is a prospective of a spray nozzle assembly having a boom mounting arrangement embodying the present invention.

The spray tip 18, cap 16, and their mounting arrangement on body member 14 in this case are of a type disclosed in Butterfield, et al., application Ser. No. 382,912 filed May 28, 1982 and assigned to the same assignee as the present invention, and the disclosure of that application is incorporated herein by reference. The spray tip 18 is appropriately seated in the cap 16, which in turn is telescoped over the lower end of the body member 14. The lower or outer most end of the tip 18 is shaped in a known manner to form the desired spray pattern to pressurized liquid exiting from the nozzle. For locking the cap 16 and spray tip 18 in relatively precise predetermined position on the lower end of the body member 14, a pair of lugs 25 on the depending body member **14*a* cooperate with respective positioning and locking slots 26 in the cap. When the cap 16 is first applied to the body member 14, the cap is positioned to register the lugs 25 with respective access grooves 28 in the cap which permit the lugs 25 to enter the respective slots 26. The cap 16 may be rotated to the position shown in FIG. 1, with end walls 26*a* of the respective slots 26 abutting against the lugs 25. As disclosed in the above referenced application, a resilient annular gasket 17 is interposed between the lower end of body portion 14*a* and cap 16 for providing a seal between the spray tip 18 and body member 14 and for biasing the cap 16 away from the body member to hold the lugs 25 in firm engagement with the cap. Such positioning of the cap 16 thereby accurately sets the position of the spray tip 18, and thus orientation of the nozzle spray pattern, with respect to the body member 14**.

In accordance with the invention, clamping means are provided for quickly and easily mounting the nozzle assembly on the support boom without the necessity for handling of separate fastening means and without the need for disassembling the nozzle. The clamping means includes a pair of clamping elements which each have first cooperating means for positioning about opposed sides of the boom and second cooperating means for positioning about opposed sides of the nozzle, and at least one of the clamping elements carried fastening means that is engagable with the other clamping element for securing the clamping elements and the nozzle held therebetween in mounted position on the support boom. In the illustrated embodiment, clamping elements 30, 31 are provided which each have an arcuate section 30*a*, 31*a* shaped complimentary to the outer parameter of the support boom 11 and a nozzle mounting flange 30*b*, 31*b* extending outwardly from one side of the arcuate section and formed with a slot 30*c*, 31*c* shaped to receive the nozzle body member 14. The clamping element 30 in this case is positioned with its arcuate section 30*a* adjacent the underside of the support boom 11 and its nozzle mounting flange 30*b* extending substantially horizontally to one side thereof, and the clamping element 31 is positioned with its arcuate section 31*a* about the top of the boom 11 and its nozzle mounting flange 31*b* located directly above the mounting flange 30*b* of the clamping element 30. With the clamping elements 30, 31 positioned in such manner, the nozzle body receiving slots 30*c*, 31*c* of the respective clamping elements are in opposed relation such that the nozzle body 14 is captively held in the slots 30*c*, 31*c* between the flanges 30*b*, 31*b*.

In keeping with the invention, means are provided for orienting the nozzle assembly 10 in relatively precise, predetermined angular and vertical relation to the boom as an incident to mounting of the clamping elements and nozzle assembly on the support boom 11. To this end, the depending nozzle body portion 14*a* is formed with a square neck 35 located between a pair of outwardly extending horizontal flanges 36 and the nozzle receiving slots 30*c*, 31*c* of the clamping elements have complementary rectangular shapes. The nozzle body member flanges 36 preferably have an axial spacing slightly greater than the combined thicknesses of the clamping element flanges 30*b*, 31*b* so as to permit easy positioning of the mounting flanges about the neck 35. It will be appreciated that by virtue of the flat cooperating sides of the body member neck 35 and the clamping element slots 30*c* upon positioning of the clamping elements 30, 31 and nozzle body 14 into mounted position on the support boom, the body member 14 can be automatically positioned with its upper inlet portion 14b parallel to the boom 11 and the nozzle tip 18 in the desired angular orientation. The cooperating relationship between the horizontal body member flanges 36 and the clamping element mounting flanges 30*b*, 31*b* further establishes the vertical position of the nozzle assembly relative to the boom.

For securing the clamping elements in mounted position on the support boom, the clamping element 30 has a second flange 30*d* extending outwardly of the arcuate section 30*a* on a side opposite of the nozzle mounting flange 30*b* and threadably carries a fastening bolt 38. In the illustrated embodiment, as best shown in FIG. 2, when the clamping element 30 is horizontally mounted, the flange 30*d* is horizontally positioned with the mounting bolt 38 carried in upstanding relation. The clamping element 31 also is formed with a second flange 31*d*, substantially similar to the flange 30*d* of the clamping element 30, but with a slot 39 extending inwardly from one side thereof for receiving the bolt 38 of the clamping element 30 when in mounted position. The bolt receiving slot 39 and the nozzle receiving slot 31*c* preferably are located on a common side of the clamping element 31 such that when the clamping element 31 is positioned upon boom and horizontally moved to a location above the lower clamping element 30, the slots 31*c*, 39 simultaneously receive the nozzle body member 14 and bolt 38. When in such mounted position, tightening of the bolt 38 will draw the clamping elements 30, 31 into tight mounted engagement about the support boom 11 with the nozzle assembly held between the flanges 30*b*, 31*b*.

To facilitate rigid support of the nozzle assembly when in such mounted position, the nozzle support flanges 30*b*, 31*b* of the clamping elements 30, 31 preferably each extend from a fulcrum point 40 on the center line 41 of the assembled clamps outwardly away from the center line an angle $\phi$ of about 2°, as shown in FIG. 2. The opposite securing flanges 30*d*, 31*d*, on the other hand, preferably extend in parallel spaced apart relation, as viewed in FIG. 2. It will be seen that with the clamping elements 30, 31 and nozzle assembly 10 in mounted position on the support boom, as the fastening bolt 38 is tightened, the clamping elements 30, 31 will tighten about the support boom and the nozzle support flanges 30*b*, 31*b* will tend to pivot about the fulcrum point 40, biasing in the outer ends thereof into firm engagement with the opposed flanges 36 of the body member 14, thereby securely holding the nozzle body member in mounted position.

From the foregoing, it will be seen that the present invention enables quick and relatively precisely oriented mounting of the nozzles on a support boom without the need for handling of separate fasteners and without disassembling the nozzle. Vertical mounting of the nozzle assembly 10, for example, involves the steps of (1) horizontally positioning the clamping element 30 on the underside of the boom 11 with the bolt 38 in upstanding relation, (2) positioning an assembled nozzle 10 into the nozzle receiving slot 30*c* of the clamping element flange 30*b*, (3) positioning the second clamping element 31 on top of the boom 11 and sliding it into position above the first clamping element 30 such that the slots 31*c*, 39 therein receive the nozzle body 14 and clamping bolt 38, and (4) tightening of the bolt 38 to secure the clamping elements 30, 31 and the nozzle assembly 10 secured therein in rigid mounted position on the boom clamping. With clamping elements horizontally positioned on the boom, the clamping elements cooperate with the nozzle body member to automatically establish the desired vertical and angular orientation of the nozzle. To readjust the longitudinal position of the nozzle assembly on the support boom, the bolt 38 need only be loosened and the nozzle assembly 10 and clamping elements 30, 31 slid along the boom 11 to the desired location, where the bolt 38 is retightened.

We claim as our invention:

1. An apparatus for mounting a spray nozzle on a support boom comprising a pair of individual and unattached clamping elements, said clamping elements each having first and second cooperating means and being relatively positionable with respect to each other during mounting to permit selective positioning said first cooperating means of said clamping elements on opposed sides of said boom with said boom interposed therebetween and selective positioning the second cooperating means of said clamping elements on opposed sides of said nozzle, said second cooperating means each being formed with a nozzle receiving slot which upon mounting of said clamping elements are in opposed relation for receiving and captively retaining said nozzle in interposed relation between said second cooperating means, a fastening elements carried by one of said clamping elements, a fastening element slot formed in the other of said clamping elements, said fastening element being positionable into operative relation with said fastening element slot of said other clamping element as an incident to positioning of said clamping elements in mounted position on said boom and without removal of said fastening element from the clamping element in which it is carried, and said fastening element being operable without utilization of an auxiliary fastening element for securing said clamping elements in mounted position on the boom with the nozzle captively retained within the second cooperating means of said clamping elements.

2. The apparatus of claim 1 in which said second cooperating means of each clamping element is a nozzle receiving flange extending outwardly from one side of said first cooperating means and formed with a respective one said nozzle receiving slots.

3. The apparatus of claim 2 in which said clamping elements each include a second flange extending outwardly from said first cooperating means on a side opposite from said nozzle receiving flange, and said fastening element is a fastener carried in the second flange of one of said clamping elements and said fastening element slot is formed in the second flange of the other one of said clamping elements.

4. The apparatus of claim 3 in which said fastener is a bolt threadably carried in upstanding relation in the second flange of said one clamping element.

5. The apparatus of claim 3 in which said fastening element slot is formed in one side of said second flange.

6. The apparatus of claim 5 in which said fastening element slot and said nozzle receiving slot of said other clamping element are formed in a common side of the clamping element.

7. The apparatus of claim 3 in which said nozzle receiving flange slots each are formed with flats for cooperating engagement with said nozzle to angularly orient the nozzle relative to the boom as an incident to mounting of the clamping elements and nozzle on said boom.

8. The apparatus of claim 3 in which said nozzle receiving flanges of the mounted clamping elements extend outwardly at a relatively small angle with respect to each other from a common point of contact immediately adjacent the first cooperating means of said clamping elements.

9. The apparatus of claim 8 in which said second flanges of said mounted clamping elements are disposed in parallel spaced apart relation with respect to each other.

10. A spray apparatus comprising a nozzle having a body, a nozzle support boom, a pair of individual and unattached clamping elements each having first and second cooperating means and being relatively positionable with respect to each other during mounting to permit selective positioning said first cooperating means of said clamping elements on opposed sides of said boom with said boom interposed therebetween and selective positioning the second cooperating means of said clamping elements on opposed sides of said nozzle, said second cooperating means each being formed with a nozzle receiving slot which upon mounting of said clamping elements are in opposed relation for receiving and captively retaining said nozzle in interposed relation between said second cooperating means, a fastening element carried by one of said clamping element, a fastening element slot formed in the other of said clamping elements, said fastening element being positionable into operative relation with said fastening element slot of said other clamping element as an incident to positioning of said clamping elements and nozzle in mounted position on said boom and without removal of said fastening element from the clamping element in which it is carried, and said fastening element being operable without utilization of an auxiliary fastening element for selectively engaging the other of said clamping elements for securing said clamping elements in mounted position on the boom with the nozzle captively retained by the second cooperating means of said clamping elements.

11. The apparatus of claim 10 in which said second cooperating means of each clamping element is a flange extending outwardly from one side of the first cooperating means and formed with said nozzle receiving slot, and said nozzle body has means which cooperate with said nozzle receiving slots of said flanges for angularly orienting the nozzle with respect to said boom as an incident to being mounted on said boom by said clamping elements.

12. The apparatus of claim 11 in which said nozzle receiving flange slots are formed with flats, and said angular orienting means of said body member are flats which cooperate with the flats of said nozzle receiving slots.

13. The apparatus of claim 12 in which said nozzle body has a pair of transverse flats spaced on opposite sides of said angular orienting flats for cooperating with said clamping element flanges to vertically orient the nozzle body relative to the boom as an incident to being mounted on said boom by said clamping elements.

14. The apparatus of claim 13 in which said nozzle body has a fluid inlet portion and a fluid discharge portion disposed perpendicularly to the inlet portion, and said clamping element flanges cooperate with said nozzle body flats to automatically locate the body with said inlet portion parallel to said boom and said discharge portion in perpendicular relation to said boom as an incident to being mounted on said boom.

* * * * *